United States Patent [19]

Smith

[11] Patent Number: 4,850,072

[45] Date of Patent: Jul. 25, 1989

[54] MOP HEAD FOR HOLDING A REMOVABLE MOP

[75] Inventor: Nathaniel Smith, Colt, Ark.

[73] Assignee: Smith Inventions Inc., Colt, Ark.

[21] Appl. No.: 39,524

[22] Filed: Apr. 17, 1987

[51] Int. Cl.[4] ..... A47L 13/20

[52] U.S. Cl. ..... 15/147 R; 15/150; 15/151

[58] Field of Search ..... 15/146, 147 C, 147 R, 15/150, 151, 228, 229 A, 229 B

[56] References Cited

U.S. PATENT DOCUMENTS

| | | | |
|---|---|---|---|
| 44,081 | 1/1864 | Sheldon . | |
| 512,492 | 1/1894 | Triphagen | 15/151 |
| 659,918 | 10/1900 | Froberg | 15/150 |
| 798,134 | 8/1905 | Kelley et al. | 15/151 |
| 899,437 | 9/1908 | Rivers . | |
| 1,245,990 | 11/1917 | Shannahan . | |
| 1,358,076 | 11/1920 | Golden | 15/150 |
| 1,608,898 | 11/1926 | Mastrony | 15/151 |
| 2,122,164 | 6/1938 | Van Buskirk | 15/151 |
| 2,305,352 | 12/1942 | Helminiak | 15/151 |
| 2,712,144 | 7/1955 | Dunn | 15/151 |
| 4,422,203 | 12/1983 | Zenker | 15/151 |

OTHER PUBLICATIONS

"Plastic Mop Handles" and Metal Mop Handles by White, catalog p. 5, publication date unknown.

"Wet Mop Handles" by Standardized Sanitation Systems, Inc., catalog p. 8, publication No. 52-584A, publication date unknown.

"Mop Sticks, Squeegees, Sponge Mops and Accessories" by Continental, catalog pp. 24 and 25, publication date unknown.

*Primary Examiner*—Philip R. Coe

*Assistant Examiner*—Corinne M. Reinckens

*Attorney, Agent, or Firm*—Weston, Hurd, Fallon, Paisley & Howley

[57] ABSTRACT

A mop head for holding a removable mop includes first and second elongate support members that are movable relative to each other to clamp a mop therebetween. The support members are releasably connected to each other at one end by a projection which can be fitted into an opening, and are connected to each other at the other end by a spring-biased handle. The support members can be pivoted relative to each other to enable a mop to be removed and replaced easily. In an alternative embodiment, the support members can be displaced relative to each other by a movable portion of a handle.

16 Claims, 2 Drawing Sheets

MOP HEAD FOR HOLDING A REMOVABLE MOP

BACKGROUND OF THE INVENTION

1. Field of the Invention

The invention relates to mop heads for holding removable mops of the type wherein the mops are clamped between relatively movable support members.

2. Description of the Prior Art

Mop heads for holding removable mop heads have been known for a number of years. In general, these mop heads include parallel, relatively movable support members disposed at the end of an elongate handle. Upon displacing the support members toward or away from each other, a mop can be clamped or released. Representative mop heads are disclosed in the following U.S. Pat. Nos.: 44,081; 798,134; 899,437; 1,245,990; 2,305,352; 2,712,144.

The referenced patents disclose that it is known to use a spring to bias a support member in the form of a movable bar relative to the stationary bar in order to clamp the mop in place. The referenced patents also disclose the concept of using prongs on one of the support members to assist in holding the mop in place. The patents to Helminiak, U.S. Pat. No. 2,305,352 and Dunn, U.S. Pat. No. 2,712,144 also disclose that it is known to move a portion of the handle, or a movable element attached to the handle, in order to change mops. Yet additionally, the concept of pivoting a movable support member relative to a stationary support member in order to make it easier to remove a soiled mop is known as shown by the patents to Dunn and Rivers, U.S. Pat. No. 899,437.

Despite the teachings of the prior art, certain problems have not been addressed. One of these problems relates to the size and complexity of the components of the mop head. Typically, springs are used to compress the mop between the relatively movable supports. In order to hold the mop tightly in place, the springs must be quite large and strong. Certain of the prior art devices employ two springs, one at each side of the support members. Desirably, only one spring would be used in order to minimize the number of components, and that spring would be smaller and easier to compress than those disclosed in the prior art.

An additional problem not adequately addressed by the prior art relates to the technique by which soiled mops are removed from the mop head. In those instances where the mop is clamped between two support members which are always maintained parallel to each other, the operator must remove a soiled mop by hand. Also, inserting a fresh mop is more difficult than desired because it must be fitted between the two parallel members. The previously mentioned patents to Rivers and Dunn disclose movable support members which can be moved to a non-parallel position relative to a stationary support member. Presumably the non-parallel support members can enable mops to be changed easier. Unfortunately, Rivers' movable support bar pivots in the same plane in which it opens and closes, and it also includes an elongate leg, both of which contribute to making it still relatively difficult to replace mops. Similarly, the Dunn patent discloses a movable bar which carries the mop and which can be pivoted away from a stationary support member, but the stationary support member must have spring pressure removed from it before the movable bar can be displaced. This feature of the Dunn device makes it relatively difficult to change mops.

SUMMARY OF THE INVENTION

The present invention overcomes the foregoing and other difficulties of the prior art devices and provides a new and improved mop head having a number of functional advantages. The mop head according to the invention employs first and second elongate members disposed generally perpendicular to the longitudinal axis of a handle and parallel to each other. The two support members are movable relative to each other between open and closed positions to clamp a mop therebetween. One end of a selected one of the support members includes an opening into which a projection formed at the end of the other support member can be fitted. A spring is in engagement with the other end of the first and second support members, the spring urging the first and second support members toward each other. By this arrangement, upon a mop being inserted between the two support members and upon release of the spring, the projection will be fitted into the opening and twisted sideways. A cutout is formed in the side of the projection in order to insure that the projection is held tightly in place within the opening.

In a preferred embodiment, the end of the support member carrying the spring includes a handle attached to the movable support member. The handle extends through an opening in the stationary support member. Accordingly, upon pushing the handle and, hence, the movable support member to the open position, the handle can be turned such that the movable support member pivots out of the plane in which the stationary support member lies. This feature of the invention enables mops to be changed quickly, without the operator having to contact the soiled mop. In an alternative embodiment of the invention, the handle includes a movable element which contacts the handle end of the movable support member, thereby avoiding the need for the operator to grasp any portion of the support member in order to remove a soiled mop.

The foregoing and other features and advantages of the invention will be apparent from reviewing the following description and claims, taken in conjunction with the accompanying drawings.

DESCRIPTION OF THE PREFERRED EMBODIMENT

Figure 1:
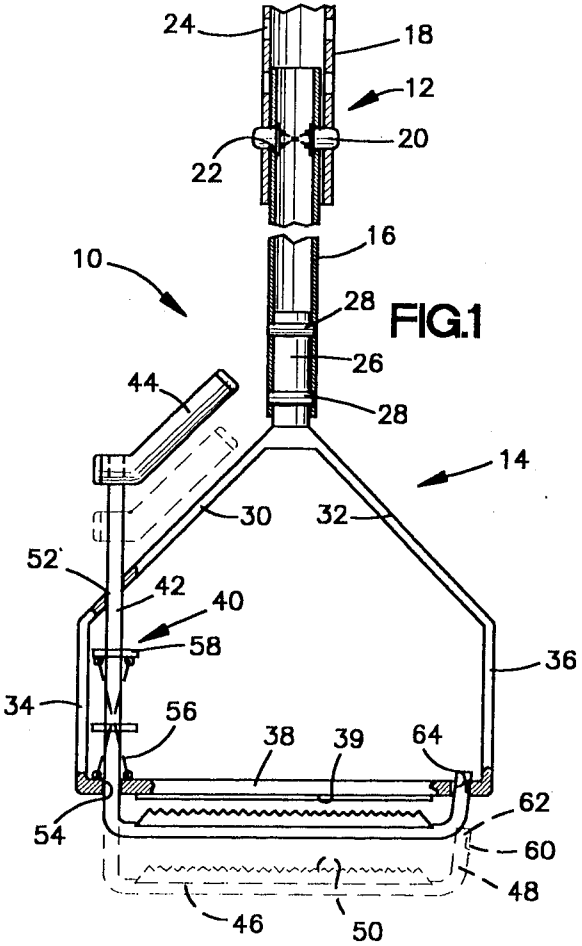
FIG. 1 is a schematic view of a mop head according to the invention, showing a movable support member in open and closed positions.

Referring to FIG. 1, a mop head according to the invention is indicated generally by the reference numeral 10. The mop head 10 includes a handle 12 which carries a frame 14 at one end. The handle 12 includes a lower tube 16 and an upper tube 18. The tubes 16 and 18 can be telescoped relative to each other to change the length of the handle 12. A button clip 20 extends through openings formed in the tubes 16, 18. One set of openings 22 is provided for the lower tube 16, while a plurality of openings 24 are provided for the tube 18 along its length. The clip 20 and the openings 22, 24 thus cooperate to permit the handle 12 to be extended to any desired length and maintained in that position.

The frame 14 includes a post 26. The post 26 extends into the end of the tube 16 where it is secured by pins 28. The frame 14 also includes diverging arms 30, 32, extensions 34, 36 extending from the arms 30, 32, respectively, and a bar 38 extending between, and connecting, the ends of the extensions 34, 36. A backing member 39 is secured to the bar 38 on that side of the bar 38 opposite the handle 12. As can be seen in FIG. 1, the extensions 34, 36 are aligned generally parallel with the longitudinal axis of the handle 12, while the bar 38 is disposed generally perpendicular to the longitudinal axis of the handle 12. Because the previously described elements of the frame 14 are rigidly connected to each other and to the tube 16, the bar 38, in effect, defines a stationary, elongate support member.

The frame 14 also includes a movable support member indicated by the reference numeral 40. The support member 40 is generally L-shaped and includes an elongate portion 42 disposed adjacent, and generally parallel to, the extension 34. The portion 42 has a handle 44 secured at one end adjacent the end of the tube 16 and a bar 46 extending laterally from the other end. The end of the bar 46 includes a projection 48 disposed adjacent, and generally parallel to, the extension 36. The bar 46 carries a row of serrated teeth 50 facing toward the backing member 39. The portion 42 extends loosely through a pair of aligned openings 52, 54 formed in the arm 30 and the bar 38, respectively. A compression spring 56 is fitted about the portion 42 and is held in place against the bar 38 by a washer 58 which in turn is held in place by a pin (not shown) extending through the portion 42. The projection 48 includes a notch 60 formed near its end on that side of the projection 48 facing away from the portion 42. The notch 60 defines a lip 62 at the end of the projection 48. The projection 48 fits into an opening 64 formed in the bar 38 near the end of the bar 38.

Figure 3:
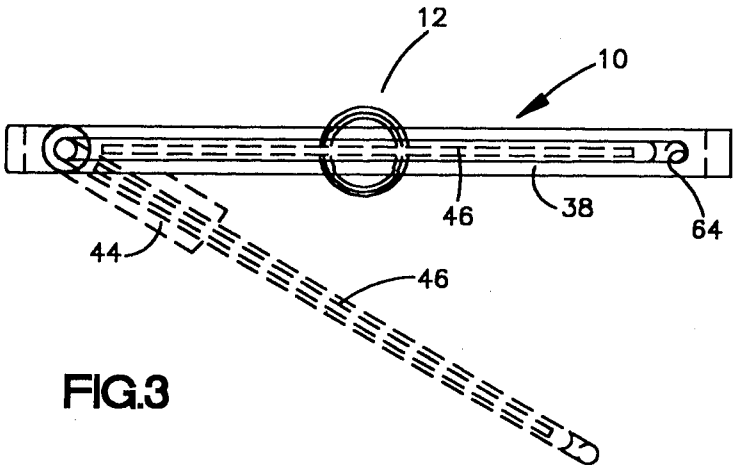
FIG. 3 is an end view of the mop head of FIG. 2 showing the movable support member being pivoted out of the plane in which a stationary support member lies.

As will be apparent from an examination of FIG. 1, when the handle 44 is pushed to the dotted line position, the support member 40 will be moved to an open position. Thereafter, upon rotating the portion 42 about its longitudinal axis, the bar 46 will be pivoted out of the plane in which the bar 38 lies (FIG. 3). With the support member 40 in its open, pivoted position, a soiled mop can be removed from the mop head 10 without the operator touching the mop. A clean mop can be draped over the bar 46. Thereafter, after pivoting the bar 46 into parallel alignment with the bar 38, the operator can release the handle 44, whereupon the movable support member 40 will be moved to the closed position shown by the full lines in FIG. 1 under the influence of the spring 56.

Figure 2A:
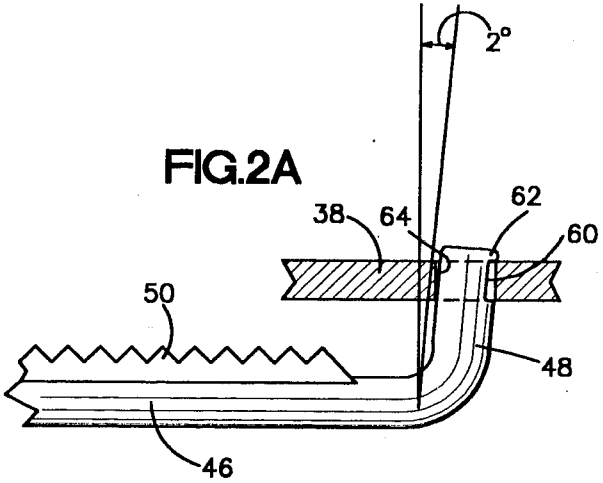
FIG. 2A is an enlarged view of a portion of the mop head of FIG. 1 showing the movable support member in the closed position.
Figure 2B:
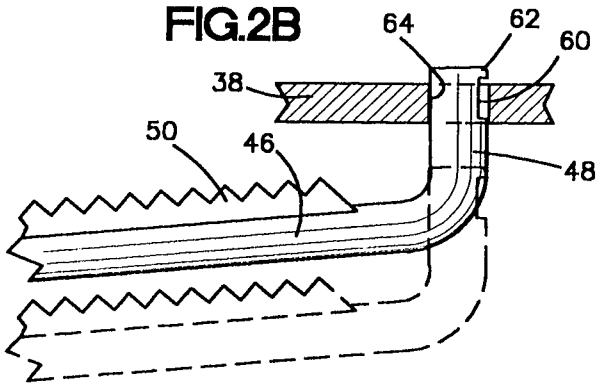
FIG. 2B is a view similar to FIG. 2A showing the movable support member being moved to the open position.

A feature of the invention is that only one spring 56 is used, and that spring can be relatively weak in comparison with springs employed with prior mop heads. This advantage is made possible, in part, by the particular construction of the movable support member 40 and the way in which it interacts with the remaining components of the frame 14. Referring particularly to FIG. 2A, it will be noted that the longitudinal axis of the projection 48 is disposed at an angle of about 92° to the longitudinal axis of the bar 46. The bar 46, in turn, is disposed at an angle of about 88° to the longitudinal axis of the portion 42. It also will be noted that the notch 60 is approximately the same width as the thickness of the bar 38. In the closed position, the lip 64 is fitted over the back face of the bar 38 at the periphery of the opening 64. During the initial stages of an opening operation, force applied to the handle 44 will cause the movable support 40 to be cocked relative to the bar 38, eventually causing the projection 48 to be aligned with the arm 36. See the full line position of the bar 46 in FIG. 2B. At this point, the lip 62 and the opening 64 will become disengaged. As further force is applied to the handle 44, the entire support member 40 will be moved relative to the bar 38. Eventually, the projection 48 will clear the opening 64, whereupon the bar 46 can be pivoted as described previously.

During a closing operation, the force being applied to the handle 44 will continue to cause the projection 48 to be aligned with the extension 36. As the lip 62 clears the inner edge of the opening 64, the notch 60 will fully engage the opening 64. A further release of force on the handle 44 will cause the bar 46 to be pivoted about the lip 62. Depending upon the strength of the spring 56 and the thickness of the mop being compressed between the bars 38, 46, the projection 48 will be wedged tightly in place within the opening 64. The wedging of the projection 48, coupled with the interaction of the lip 62 and the opening 64, causes the mop to be tightly clamped in place between the bars 38, 46.

An Alternative Embodiment

Figure 4:
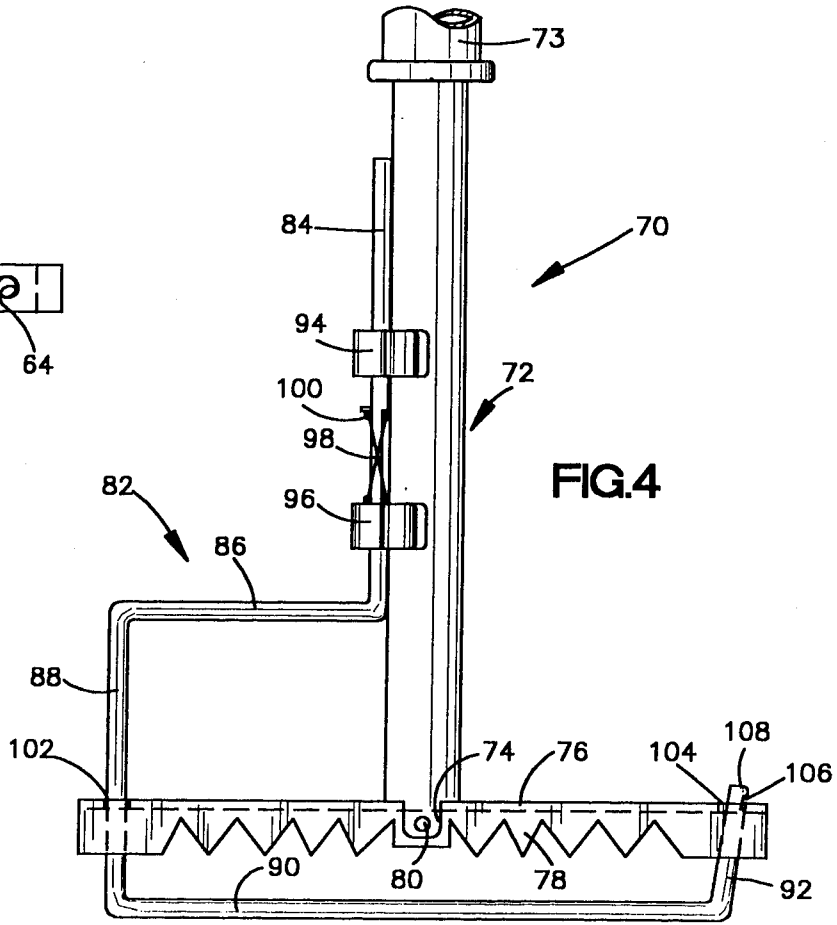
FIG. 4 is a view similar to FIG. 1 showing an alternative embodiment of the invention.

Referring particularly to FIG. 4, an alternative embodiment of the invention is indicated by the reference numeral 70. The alternative embodiment of the invention is a smaller, less expensive version of the invention that operates in the same manner as the mop head 10 described above.

The mop head 70 includes a handle 72 similar to the handle 12 of the mop head 10. In FIG. 4, the upper portion of the handle 72 has been omitted, but a movable flanged portion 73 is illustrated. The lower end of the handle 72 includes a pair of bifurcated tabs 74 between which a bar 76 having serrations 78 is secured by means of suitable fasteners such as rivets 80. The bar 76, like the bar 38, defines a stationary support member. The mop head 70 also includes a movable support member 82. The movable support member 82 includes a first elongate portion 84 disposed adjacent the handle 72, a laterally projecting portion 86, a second elongate portion 88 aligned parallel with the portion 84, a bar 90 aligned generally parallel with the portion 86 and the bar 76, and a projection 92 aligned generally parallel with the longitudinal axis of the handle 72. A pair of spaced brackets 94, 96 surround the portion 84 and hold the portion 84 against the handle 72. The brackets 94, 96 hold the portion 84 loose enough, however, that the portion 84 can be moved axially of the handle 72 without difficulty and so that the movable support member 82 can be cocked relative to the bar 76. A spring 98 is disposed about the portion 84 intermediate the brackets 94, 96. A pin 100 constrains the upper end of the spring 98, while the upper side of the bracket 96 constrains the lower end of the spring 98. The portion 88 extends through an opening 102 formed in the bar 76 near the first end of the bar 76, while the projection 92 extends through an opening 104 formed near the other end of the bar 76. The end of the projection 92 includes a notch 106 and a lip 108. The various elements of the stationary support 76 and the movable support 82 cooperate to function the same as the corresponding components of the mop head 10 in holding a mop in place.

The most significant difference between the mop head 10 and the mop head 70 is that the mop head 70 does not include a handle at the upper end of the portion 84. Rather, because the portion 84 is disposed adjacent the handle 72, and because the movable portion 73 can be moved axially of the handle 72, it is apparent that the movable support 82 will be actuated upon moving the portion 73 toward the stationary support 76. That is, the flanged lower end of the portion 73 and the upper end of the portion 84 will contact each other and, upon the portion 73 being pushed by the operator toward the lower end of the handle 72, the movable member 82 will be moved to an open position. Upon moving the portion 73 to a raised position, force on the portion 84 will be removed and the movable support 82 will be retracted under the influence of the spring 98 to the closed position shown in FIG. 4. The movable support 82 also can be opened and closed by applying force to the laterally projecting portion 86. Although the mop head 70 has various advantages, it suffers the drawback of not being able to pivot the bar 90 out of the plane in which the bar 76 lies.

It is expected that most of the components of the mop heads 10, 70 will be manufactured from a lightweight, relatively inexpensive material such as aluminum. The various materials, dimensions, tolerances, and other manufacturing considerations needed to manufacture a mop head according to the invention will be apparent to those skilled in the art, and further discussion concerning such considerations is not necessary. Further, although such relative terms as "upper," "lower," and so forth have been used herein for purposes of convenience, it is to be understood that no particular spatial orientation of the invention or its components is to be implied from such usage.

While the invention has been described in its preferred form with a certain degree of particularity, it will be apparent that various changes and modifications can be made without departing from the true spirit and scope of the invention as hereinafter claimed. It is expected that the patent shall cover all such changes and modifications. It also is intended that the patent shall cover, by suitable expression in the appended claims, whatever features of patentable novelty exist in the invention disclosed.

What is claimed is:

1. A mop head for holding a removable mop, the mop head being disposed at one end of an elongate handle, comprising:

a first, elongate support member disposed generally perpendicular to the longitudinal axis of the handle, the first support member having a first end and a second end;

a second elongate support member disposed generally parallel to the first support member, the second support member having a first end disposed adjacent the first end of the first support member and a second end disposed adjacent the second end of the second support member;

the first and second support members being movable relative to each other between open and closed positions to clamp the mop therebetween;

a spring in engagement with the first end of the first and second support members, the spring urging the first and second support members toward each other; and the second end of a selected one of the first or second support members having an opening and the second end of the other of the first or second support member having a projection adapted to be tightly fitted within the opening when the first and second support members are in the closed position, the projection including a notch that defines a lip at the end of the projection, the lip being engageable with the opening when the first and second support members are in the closed position, the first and second support members being pivoted with respect to each other about the lip under ther influence of the ring.

2. The mop head of claim 1, wherein the first end of the first support member has an opening, and the first end of the second support member includes a handle portion, the handle portion extending through the opening in the first end of the first support member.

3. The mop head of claim 2, wherein the spring is in engagement with the handle portion and the first support member.

4. The mop head of claim 2, wherein the handle portion is spaced apart from the elongate handle.

5. The mop head of claim 2, wherein the handle portion is disposed adjacent the elongate handle.

6. The mop head of claim 5, wherein the elongate handle has a movable portion that is engageable with the handle portion and actuates the handle portion.

7. The mop head of claim 1, wherein the opening is formed in the first support member, and the projection extends from the second support member.

8. The mop head of claim 1, wherein the first support member is stationary relative to the handle.

9. The mop head of claim 1, wherein the first and second support members can be moved to a non-parallel position when the first and second support members are in the open position.

10. The mop head of claim 9, wherein the movement of the first and second support members to a non-parallel position is accomplished by pivoting the second support member about its first end.

11. A mop head for holding a removable mop, the mop head being disposed at one end of an elongate handle, comprising:

a first, elongate support member disposed generally perpendicular to the longitudinal axis of the handle, the first support member having a first end and a second end;

a frame connecting the first end and the second end to the handle;

a second elongate support member disposed generally parallel to the first support member, the second support member having a first end disposed adjacent the first end of the first support member and a second end disposed adjacent the second end of the second support member;

the second support member being movable relative to the first support member between open and closed positions to clamp the mop therebetween;

the first end of the first support member has an opening, and the first end of the second support member includes a handle portion, the handle portion extending through the opening in the first end of the first support member;

a spring in engagement with the handle portion and the first support member, the spring urging the first and second support members toward teach other; and the second end of the first support member having an opening and the second end the second support member having a projection adapted to be tightly fitted within the opening when the second support member is in the closed position, the projection including a notch that defines a lip at the end of the projection, the lip being engageable with the opening when the first and second support members are in the closed position, the first and second support members being pivoted with respect to each other about the lip under the influence of the spring.

12. The mop head of claim 11, wherein the handle portion is spaced apart from the elongate handle.

13. The mop head of claim 11, wherein the handle portion is disposed adjacent the elongate handle.

14. The mop head of claim 13, wherein the elongate handle has a movable portion that is engageable with the handle portion and actuates the handle portion.

15. The mop head of claim 11, wherein the first and second support members can be moved to a non-parallel position when the second support member is in the open position.

16. The mop head of claim 15, wherein the movement of the first and second support members to a non-parallel position is accomplished by pivoting the second support member about its first end.

* * * * *